US006137099A

United States Patent [19]

Hamblin

[11] Patent Number: 6,137,099

[45] Date of Patent: Oct. 24, 2000

[54] FOOD PACKAGING FOR MICROWAVE COOKING HAVING A CORRUGATED SUSCEPTOR WITH FOLD LINES

[75] Inventor: Geoffrey Ronald Hamblin, Willoughby, Australia

[73] Assignee: Pak Pacific Corporation Pty., Ltd., Australia

[21] Appl. No.: 08/849,266

[22] PCT Filed: Nov. 17, 1995

[86] PCT No.: PCT/AU95/00760

§ 371 Date: Mar. 25, 1998

§ 102(e) Date: Mar. 25, 1998

[87] PCT Pub. No.: WO96/15958

PCT Pub. Date: May 30, 1996

[30] Foreign Application Priority Data

Nov. 17, 1994 [AU] Australia ..... PM 9481

[51] Int. Cl.[7] ..... H05B 6/80; B65D 81/34

[52] U.S. Cl. ..... 219/730; 219/735; 426/118; 426/234; 99/DIG. 14

[58] Field of Search ..... 219/730, 725, 219/759, 734, 735, 732; 426/107, 113, 118, 234, 241; 99/DIG. 14

[56] References Cited

U.S. PATENT DOCUMENTS

| | | | |
|---|---|---|---|
| 3,926,362 | 12/1975 | Beck et al. | 229/125.19 |
| 4,059,220 | 11/1977 | Lorenz | 229/159 |
| 4,267,420 | 5/1981 | Btastad . | |
| 4,777,053 | 10/1988 | Tobelmannn et al. | 426/107 |
| 4,780,587 | 10/1988 | Brown . | |
| 4,801,077 | 1/1989 | Sweatt, III et al. | 229/113 |
| 4,935,502 | 6/1990 | Kühne et al. . | |
| 4,935,592 | 6/1990 | Oppenheimer . | |
| 5,077,455 | 12/1991 | Peleg et al. | 219/730 |
| 5,175,404 | 12/1992 | Andreas et al. . | |
| 5,310,977 | 5/1994 | Stenkamp et al. | 219/730 |
| 5,334,820 | 8/1994 | Risch et al. . | |
| 5,369,256 | 11/1994 | Woods | 219/730 |

FOREIGN PATENT DOCUMENTS

| | | |
|---|---|---|
| 14818/33 | 6/1934 | Australia . |
| 250443 | 4/1963 | Australia . |
| 182110/88 | 1/1989 | Australia . |
| 86700/91 | 8/1992 | Australia . |
| WO9107861 | 5/1991 | WIPO . |

*Primary Examiner*—Philip H. Leung
*Attorney, Agent, or Firm*—Price, Heneveld, Cooper, DeWitt & Litton

[57] ABSTRACT

Packaging (3) for causing the outside surface of a food product to crisp and/or brown when the food product is heated in a microwave oven. The packaging comprises a corrugated sheet (5) of a susceptor material (e.g., metalised polyester) adapted to be wrapped at least partially around the food product. The corrugated sheet may have adhered thereto a backing sheet (7) of paper or cardboard.

7 Claims, 1 Drawing Sheet

FOOD PACKAGING FOR MICROWAVE COOKING HAVING A CORRUGATED SUSCEPTOR WITH FOLD LINES

The present invention relates to a package for use in heating a food product in a microwave oven.

The term "food product" is understood herein to cover any un-cooked and part-cooked food product that, in a cooked state, is intended to have a crisped and/or browned outer surface. In particular, the term "food product" is intended to cover, but is not limited to, foods encased in pastries, such as pies, pasties, and pizzas, and flash fried products, such as chips.

A long-standing problem of commercial and domestic microwave ovens is that the ovens are not able to "crisp" and/or "brown" the outer surface of food products of the type described in the preceding paragraph. This is a significant problem in both the convenience/fast food market sector and the retail market sector.

The use of "susceptor" materials (also known as "microwave interactive materials") has been proposed to solve the crisping and/or browning problem of microwave ovens.

The term "susceptor" material is understood herein to mean a material which is capable of absorbing microwave energy and releasing the energy in the form of heat energy.

A known susceptor material is metallised polyester. Typically, this material has an optical density of 0.24±10%.

One particular susceptor material-based package is disclosed in Australian patent 635,667 entitled "A Container" in the name of Amcor Limited.

The package disclosed in the patent comprises a carton which is designed to store hygienically a food product, such as a pastie, prior to the food product being heated in a microwave oven. The package is also designed to cause the outer surface of the food product to crisp and/or brown as the food product is being heated in a microwave oven.

The package disclosed in the patent includes sheets of corrugated metallised polyester positioned on the inner surfaces of the top and bottom panels of the carton. The corrugated sheets are adhered to the panels with an adhesive which is selected to melt when the carton is exposed to heat in a microwave oven. This releases the upper corrugated sheet to drop onto and thereby come into close contact with the upper surface of the food product.

The patent describes that experimental work established that B flutes achieve the best crisping and/or browning results.

The patent also describes that flute heights of between 2.4 and 3.4 mm provide acceptable results. There is no detailed explanation given of the reason for the success of the corrugated sheets. The main disclosure on this issue is a sentence commencing at line 18 of page 7 which reads as follows:

> "These corrugations not only ensure that the food product is kept an optimum distance from the microwave interactive layer but allows moisture or oil released from the food product to escape".

The crisping and/or browning performance of the package disclosed in the patent, whilst better than that obtained with other susceptor material-based packages known to the applicant, did not reach a level that was thought would be successful commercially. In addition, the cost of the carton is prohibitive, particularly for use in the retail market sector. Also, structurally, the carton is not suited to the retail market sector.

An object of the present invention is to provide a package for causing the outside surface of a food product to crisp and/or brown when the food product is heated in a microwave oven which alleviates the disadvantages of the known susceptor-based packages discussed above and in particular is viable commercially in the retail market sector.

According to one aspect of the present invention there is a provided a package for causing the outside surface of a food product to crisp and/or brown when the food product is heated in a microwave oven, the package comprising a corrugated sheet of a susceptor material that is adapted to be wrapped at least partially around the food product.

The extent to which it is necessary that the sheet be adapted to wrap around a food product is a function of a number of factors, such as the size, shape, and nature of the food product. In some instances, it is preferred that the sheet be adapted to substantially enclose a food product.

It is preferred that the package comprises vents to allow moisture to escape from the food product.

It is preferred that the corrugated sheet comprises fold lines which enable the sheet to be folded at the fold lines to allow the corrugated sheet to be wrapped around the food product.

It is preferred that the sheet be flat.

It is preferred particularly that the corrugated sheet comprises pre-cut sections that form vents when the corrugated sheet is wrapped around the food product.

It is preferred that the pre-cut sections form part of the fold lines.

It is preferred that the package further comprises a sheet of a backing material adhered to the corrugated sheet of the susceptor material.

It is preferred that the susceptor material be metallised polyester.

It is preferred that the backing material be paper or cardboard.

It is preferred particularly that the corrugated sheet have flutes that are less than about 2.4 mm in height. It is noted that a flute height of about 2.4 mm describes an "E" flute.

According to another aspect of the present invention there is provided a package for causing the outside surface of a food product to crisp and/or brown when the food product is heated in a microwave oven, the package comprising a corrugated sheet of a susceptor material adapted to contact at least partially the outer surface of the food product, the corrugated sheet having flutes that are less than about 2.4 mm in height.

It is preferred that the package comprises vents to allow moisture to escape from the food product.

It is preferred that the corrugated sheet comprises fold lines which enable the sheet to be folded at the fold lines to allow the corrugated sheet to be wrapped around the food product.

It is preferred that the sheet be flat.

It is preferred particularly that the sheet comprises pre-cut sections that form vents when the corrugated sheet is wrapped around the food product.

It is preferred that the pre-cut sections form part of the fold lines.

It is preferred that the package further comprises a sheet of a backing material adhered to the corrugated sheet of susceptor material.

It is preferred that the susceptor material be metallised polyester.

It is preferred that the backing material be paper or cardboard.

According to another aspect of the present invention there is provided a method of manufacturing a package that is adapted for wrapping at least partially around a food product for causing the outside surface of the food product to crisp and/or brown when the food product is heated in a microwave oven, the method comprising the steps of:

(a) feeding a sheet of a susceptor material through a nip of a pair of rollers to form corrugations in the sheet;

(b) applying adhesive to one or other or both of the corrugated sheet and a sheet of a backing material; and (c) bringing together the sheets to form the package.

It is preferred that the method further comprises forming fold lines in the sheet of the susceptor material.

The present invention is described by way of example hereinafter with reference to the accompanying drawings in which.

The packages 3 shown in Figures are suited for use in both the convenience/fast food and the retail market sectors.

Figure 1:
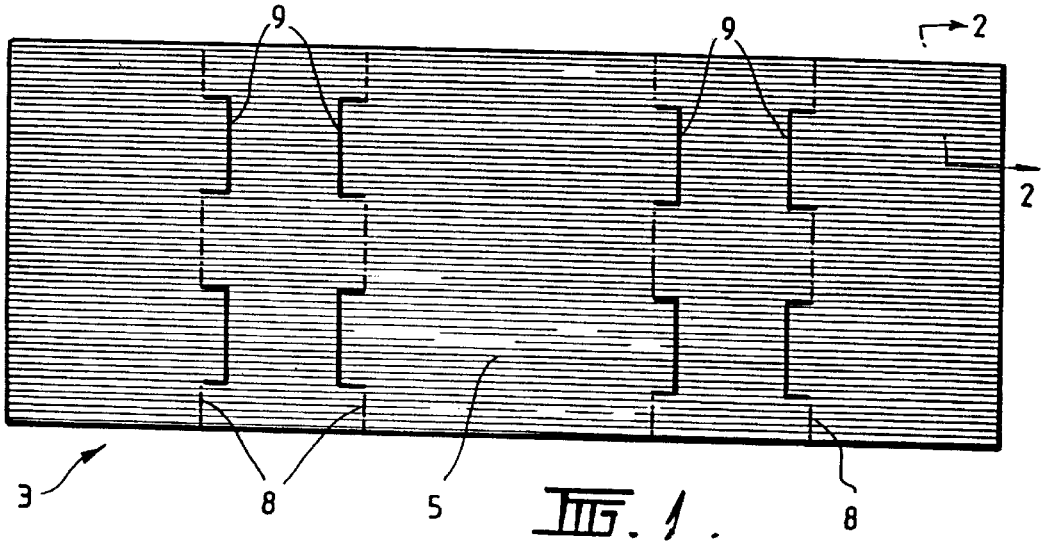
FIG. 1 is a top plan view of one preferred embodiment of a package in accordance with the present invention prior to the package being wrapped around a food product.
Figure 2:
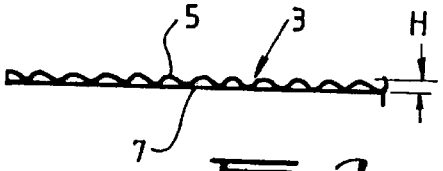
FIG. 2 is a section along the line 2—2 of FIG. 1.

In the case of the retail market sector, it is noted that the package 3 as shown in FIGS. 1 and 2 may be sold conveniently in packs of 10, 20 or any suitable number for use as required in domestic households. The package 3 as shown in FIGS. 1 and 2 may also be packed conveniently with a food product sold in the retail market sector.

With reference to FIGS. 1 and 2, the package 3 shown in these figures comprises a corrugated sheet 5 of a susceptor material adhered to a flat sheet 7 of a backing material.

Typically, the susceptor material is metallised polyester and the backing material is paper.

Figure 3:
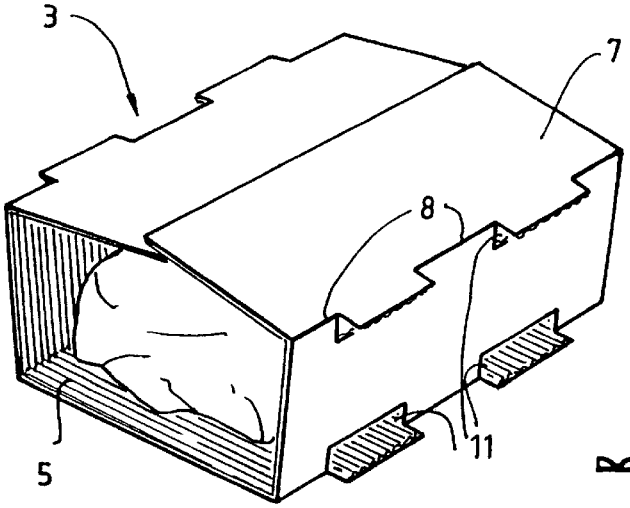
FIG. 3 is a perspective view of the package shown in FIG. 1 wrapped around a food product in the form of a pastie.

With further reference to FIG. 1, the package 3 includes a series of fold lines 8 formed in the corrugated sheet 5 and extending generally transversely to the corrugations. The purpose of the fold lines 8 is to enable the package 3 to be wrapped conveniently around a food product as shown in FIG. 3. With reference to FIG. 3, it can readily be appreciated that the folded package 3 and, more particularly, the susceptor material, is in close contact with a substantial section of the outer surface of the food product. In this connection, the folded package 3 substantially envelopes the food product—save for the end sections of the food product.

It is noted that, in contrast to the arrangement of Australian patent 635,667 discussed above, the close juxtaposition of the susceptor material and the food product as shown in FIG. 3 is achieved without the use of hot melt adhesives selected to release the corrugated sheets of susceptor material and with a comparatively inexpensive package.

It is also noted that the extent to which it is necessary that the package 3 wrap around a food product is a function of the size, shape, and nature of the food product.

In addition, with further reference to FIG. 1, sections 9 of the fold lines 8 are cut through the corrugated sheet 5 and the backing sheet 7 so that when the package 3 is wrapped around a food product the pre-cut sections form vents 11 as shown in FIG. 3.

The applicant has found that the vents 11 are an important, although by no means essential, feature in terms of the crisping and/or browning performance of the package 3. Whilst not wishing to be bound by any particular theory, the applicant believes that the vents 11 contribute to the crisping and/or browning performance by providing a means for water vapour generated during heating in the microwave oven to escape from the outer surface of the food product.

The height H (FIG. 2) of the flutes of the corrugated sheet 5 of the susceptor material may be selected as required.

Figure 4:
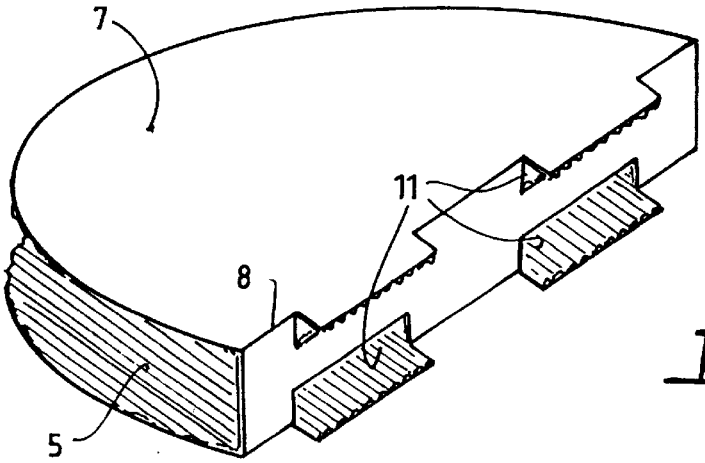
FIG. 4 is a perspective view of another preferred embodiment of a package in accordance with the present invention as the package would appear if wrapped around a food product.

With reference to FIG. 4, the package 3 shown in the figure is the same conceptually to that shown in FIGS. 1 to 3 but is a different shape, as may be preferred for particular food products.

The package 3 shown in FIG. 4 comprises a corrugated sheet 5 of a susceptor material, such as metallised polyester, adhered to a sheet 7 of a backing material such as paper. The package 3 may be sold as a flat product, with:

(a) selectively positioned fold lines 8 in the corrugated sheet 5 which enable the package 3 to be folded about the fold lines 8 into the configuration shown in FIG. 4 which can wrap conveniently around a food product (not shown); and (b) cut sections that form vents 11 when the package 3 is folded to the configuration shown in FIG. 4.

The packages 3 shown in the Figures may be manufactured in the flat form shown in FIGS. 1 and 2 by any suitable method and with any suitable means.

Typically, the packages 3 are manufactured in this form by a method which comprises:

(a) feeding a sheet of the susceptor material through the nip of a pair of rollers having corrugated surfaces that form corrugations in the sheet and, thereafter;

(b) applying adhesive to one or other (or both) of the corrugated sheet and a flat sheet of backing material and bringing together the sheets.

In a particularly preferred embodiment, where the susceptor material is a metallised polyester, the method also includes the step of perforating the metallised polyester by means of a hot needle upstream of the corrugated rollers. The hot needle seals the exposed edges of the perforated metallised polyester and, as a consequence, the perforations are retained after the metallised polyester passes through the rollers. The perforations are a from of vent and allow water vapour generated during microwave heating a food product to escape from the food product.

In accordance with a particularly preferred embodiment of the present invention the height H of the flutes of the corrugated sheets 5 of the susceptor material of the packages 3 is selected to be less than about 2.4 mm. As noted previously, this size of flute is generally known as "E" flute.

The applicant has found that the crisping and/or browning of food products is significantly better when food products are wrapped in a corrugated sheet 5 of the susceptor material that is "E" flute size or smaller than when food products are wrapped in corrugated sheets 5 of the susceptor material that have larger-sized flutes.

Many modifications may be made to the preferred embodiment of the present invention described in above without departing from the spirit and scope of the present invention.

By way of example, whilst the use of the "E" flute or smaller-sized corrugated sheets of susceptor material is described in relation to the package 3 shown in the Figures, it can readily be appreciated that this aspect of the present invention is not so limited and such corrugated sheets may be used with any suitable package.

Furthermore, whilst the vents 11 form part of the fold lines 8 in the preferred embodiment, it can readily be appreciated that the present invention is not limited to such an arrangement and the vents may be located in any suitable position.

What is claimed is:

1. A package for causing the outside surface of a food product to crisp and/or brown when the food product is heated in a microwave oven, the package comprising a corrugated sheet of a susceptor material that is adapted to be wrapped at least partially around the food product, the corrugated sheet comprising fold lines that extend transversely to the corrugations which enable the sheet to be folded at the fold lines to allow the corrugated sheet to be wrapped around the food product, and the corrugated sheet comprising pre-cut sections that provide vents when the corrugated sheet is wrapped around the food product to allow moisture to escape from the food product.

2. The package defined in claim 1 wherein the pre-cut sections form part of the fold lines.

3. The package defined in claim 1 further comprising a sheet of a backing material adhered to the corrugated sheet of the susceptor material.

4. The package defined in claim 1 wherein the susceptor material is metallized polyester.

5. The package defined in claim 4 wherein the backing material is paper or cardboard.

6. The package defined in claim 1 wherein the corrugated sheet has flutes that are less than about 2.4 mm in height.

7. A method of manufacturing a package that is adapted for wrapping at least partially around a food product for causing the outside surface of the food product to crisp and/or brown when the food product is heated in a microwave oven, the method comprising the steps of:

(a) feeding a sheet of a susceptor material through a nip of a pair of rollers to form corrugations in the sheet;

(b) applying adhesive to one or other or both of the corrugated sheet and a sheet of a backing material; and (c) bringing together the sheets to form the package;

(d) forming fold lines in the package that are transverse to the corrugations of the sheet of the susceptor material; and (e) pre-cutting sections of the corrugated sheet to provide vents when the corrugated sheet is wrapped around the food product.

* * * * *